US006746699B2

(12) United States Patent
Lohrey et al.

(10) Patent No.: US 6,746,699 B2
(45) Date of Patent: Jun. 8, 2004

(54) INFUSION BAG WITH STRING

(75) Inventors: Wilhelm Lohrey, Meerbusch (DE); Stefan Lambertz, Hürth (DE); Manfred Hauers, Viersen (DE); Dieter Vits, Neuss (DE)

(73) Assignee: Teepack Spezialmaschinen GmbH & Co. KG (DE)

( * ) Notice: Subject to any disclaimer, the term of this patent is extended or adjusted under 35 U.S.C. 154(b) by 241 days.

(21) Appl. No.: 09/874,730

(22) Filed: Jun. 5, 2001

(65) Prior Publication Data

US 2001/0053400 A1 Dec. 20, 2001

(30) Foreign Application Priority Data

Jun. 6, 2000 (EP) ..... 00112148

(51) Int. Cl.[7] ..... B65B 29/04

(52) U.S. Cl. ..... 426/83; 426/77; 426/394; 53/134.2; 53/413; 289/1.5

(58) Field of Search ..... 426/77, 83, 394; 53/134.2, 413; 289/1.5

(56) References Cited

U.S. PATENT DOCUMENTS

| | | | | |
|---|---|---|---|---|
| 2,149,713 | A | * | 3/1939 | Webber |
| 2,307,998 | A | | 1/1943 | Eaton |
| 5,657,712 | A | * | 8/1997 | Romagnoli |
| 5,797,243 | A | * | 8/1998 | Tagliaferri et al. |
| 6,216,620 | B1 | * | 4/2001 | Shepard |
| 6,343,558 | B1 | * | 2/2002 | Shepard |
| 6,499,273 | B1 | * | 12/2002 | Marzocchi |

FOREIGN PATENT DOCUMENTS

| | | | |
|---|---|---|---|
| DE | 3732729 | * | 4/1989 |
| DE | 3826911 | * | 2/1990 |
| DE | 29601442 | * | 7/1996 |
| DE | 296 13 448 | | 10/1996 |
| EP | 118602 | * | 9/1984 |
| EP | 260229 | * | 3/1988 |
| EP | 0686574 A1 | | 12/1995 |
| EP | 0 807 579 A1 | | 11/1997 |
| EP | 807580 | * | 11/1997 |
| WO | WO 95/32905 | | 12/1995 |
| WO | WO96/31395 | * | 10/1996 |

* cited by examiner

*Primary Examiner*—Steven L. Weinstein
(74) *Attorney, Agent, or Firm*—Cantor Colburn LLP

(57) ABSTRACT

This invention concerns an infusion bag, especially for tea, which has a top part with folded down corners and a middle part folded over it, to which a string with two free ends is attached that goes from one side of the top part through a hole in the folded down parts forming a loop on the other side of the top part and comes back, whereby the two free ends are drawn up through the loop laid over the top edge of the infusion bag and pulled to form a knot. The solution in the invention is characterized by the fact that two holes are made in the top part at a lateral distance next to one another, on the left and right of the longitudinal axis of the bag; each hole goes through a folded down corner and the middle of the top part; by the fact that the string forms a loop and one end goes through one hole and the other end through the second hole; by the fact that the loop is laid over the top edge of the infusion bag, and both ends of the string go up through the loop to form a double knot. The invention also concerns a method of closing an infusion bag.

3 Claims, 6 Drawing Sheets

INFUSION BAG WITH STRING

TECHNICAL FIELD

The invention concerns an infusion bag, especially for tea, which has a top part with corners folded down and a middle part folded down over it, to which a string with two free ends is attached, which goes from one side of the top part, through a hole, forming a loop on the other side of the top part and back, whereby the two free ends are pulled through the loop placed over the top edge of the infusion bag and are pulled to form a knot. The invention also concerns a method of closing an infusion bag, especially for tea, closed on top by corners folded down and then a middle part folded down, with a string, preferably having a tag on the other end, by means of two needles.

BACKGROUND OF THE INVENTION

It is known how to close infusion bags exclusively with a string. For this, the corners on top of the infusion bag are first folded down and then the middle part is folded over the folded down corners to make the closure of the infusion bag reliable. This closure is secured by a string that has several ways of being attached.

In one known embodiment in German Utility Model 296 13 448, the string on the top part of the infusion bag is attached there by means of a separate attachment string. This connection between the end of the string and the infusion bag cannot withstand high stresses and is technically expensive.

To create a simple way of attaching the string, it is known from EP 0 807 579 how to provide the folded top part with two recesses and place the infusion bag next to a tensed string in such a way that it runs at the height of the recesses and a tucking needle can be passed through each of the recesses, take the string and pull it through the recesses with both its ends. The free ends of the string pulled through the recesses in the infusion bag are attached to the tag, for example by welding or tacking. The disadvantage of this is that the attachment is loose and therefore not secure, and it is possible for the folded down areas on the top part to come unfolded, so the contents of the infusion bag can fall out or a loss of aroma and freshness can occur.

EP 0 691 268 discloses a string closure in which a needle goes through a single hole in the top part of the infusion bag, grasps the string behind and pulls it through the hole, forming a noose, which is then used to make a knot. The disadvantage of this is that it does not make sure that the folded down corners and the middle of the top part folded down over it are grasped together and with the bag by the string connection and are connected by the knot formed. The closure itself is not secure enough during folding, perforating and stringing with high manufacturing precision.

SUMMARY OF THE INVENTION

The problem of the invention is to provide a secure attachment between the folded down parts of an infusion bag and the bag itself with a string connection that can be made simply at a low technical cost and at high production speed.

The invention solves the problem with an infusion bag of the type mentioned at the beginning that has two holes made in the top part at a lateral distance next to one another to the left and right of the longitudinal axis of the bag that grasp one folded corner and the middle of the top part; that the string forms a loop with one end that goes through one hole and the other end through the second hole; that the loop is placed over the top edge of the infusion bag and both ends of the string are passed from below through the loop forming a double knot. The loop is preferably made of crossed string parts laid one over another, whereby one short end and one long end of the string can be provided, especially for attaching a tag to the long end of the string, and whereby to increase the safety of the knot, the short end of the string in the preferred embodiment is arranged in the string parts of the loop criss-crossed over one another under the long end of the string on the wall of the bag. With the invention, the attachment of the folded down corners and the folded down middle part to one another and to the bag is secure, and production is simplified because the comparatively thick, and hence difficult to tool, middle longitudinal seam of conventional bags need not be pierced or perforated. The knots keep the connection itself from loosening by two holes spaced apart and separate ends of the string ends that are doubled going through them, so that even if one end should come out of the loop, the knot through the second end of the string and the extra noose holds it secure.

Developing the known method described at the beginning, the method of solving the problem in the invention is characterized by the fact that: the end of the string is looped through a recess in a holder; by the fact that the top part of the infusion bag is inserted into the holder and the string is looped around the top edge of the infusion bag; by the fact that the string is then grasped on its free end and on its long continuous end by two holes in the top part that go through the folded down parts and the free end, as well as the continuous part that first goes into a loop and is then pulled all the way out of the infusion bag; and by the fact that the noose is finally tightened by pulling, especially on the continuous part. To grasp the string, two needles are preferably used that go through the infusion bag under the closed part of the loop, whereby the holder can have guide holes for the needles. To pull the string through, it must be cut on the continuous part, before the needles are pulled back at the latest. That way, the continuous part forms one long end of string, which can be used to attach a tag.

The method in the invention closes the folded down top part of the infusion bag exclusively using the string, and does not use extra string. The string is pulled through the top part of the infusion bag or pierces it with the needles, whereby the holder contains guide holes for the needles. The needles make only a simple motion to perforate the top part of the infusion bag, to allow a fast, simple sequence of movements. Previous perforation of the top part of the infusion bag is not essential. The top of the bag is securely closed by the two stitches to the right and left of the middle, whereby the folded down corners are also fixed. Attachment can be done in a continuous process at a calm machine pace and a high product count. The knot does not come loose due to the forces of friction even when slightly prestressed, i.e., when tightened loosely.

BRIEF DESCRIPTION OF THE DRAWINGS

With the invention, a method of closing an infusion bag with a string is created with simple technical equipment and high speed; this method will be described below with reference to the drawings using one example of embodiment.

FIGS. 7*a*, 7*b* show a corresponding side view and top view after the end of the string has been pulled through;

DETAILED DESCRIPTION OF THE PREFERRED EMBODIMENT

Figure 1A:
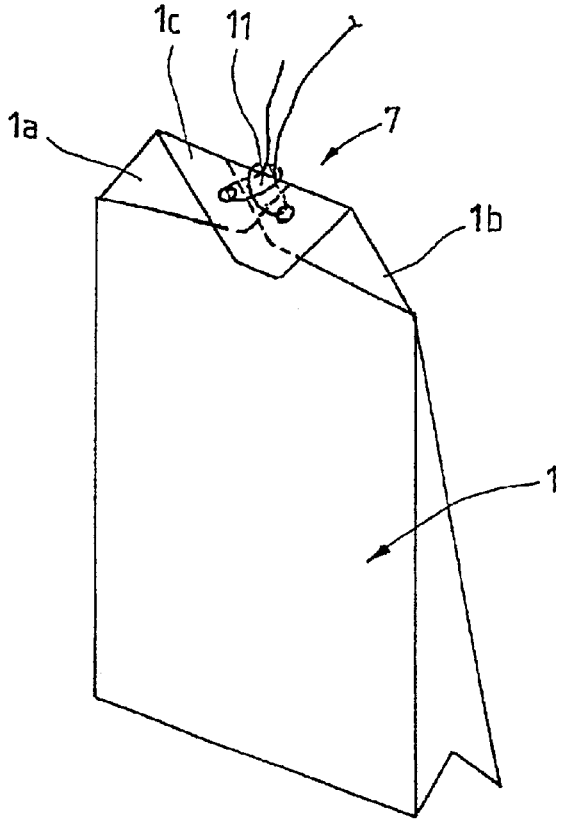
FIG. 1*a* shows a perspective view of an infusion bag with folded down comers and the middle part folded down over it, plus the string closure.
Figure 1B:
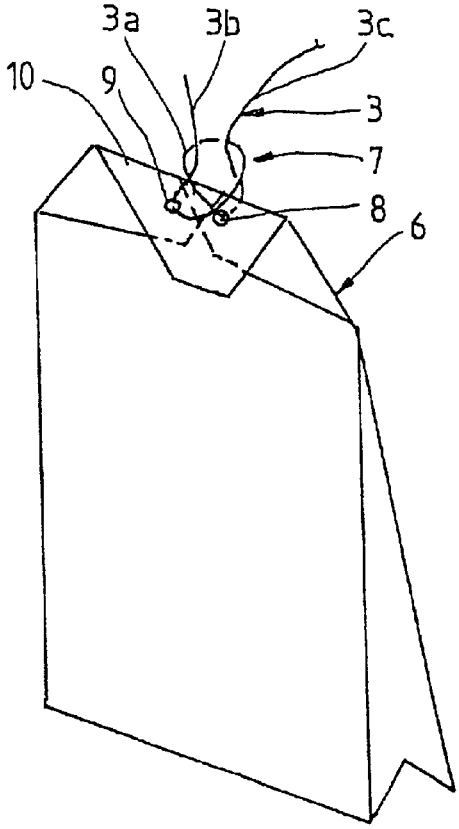
FIG. 1*b* shows the infusion bag in FIG. 1*a* with an enlarged view of the string closure.
Figure 1C:
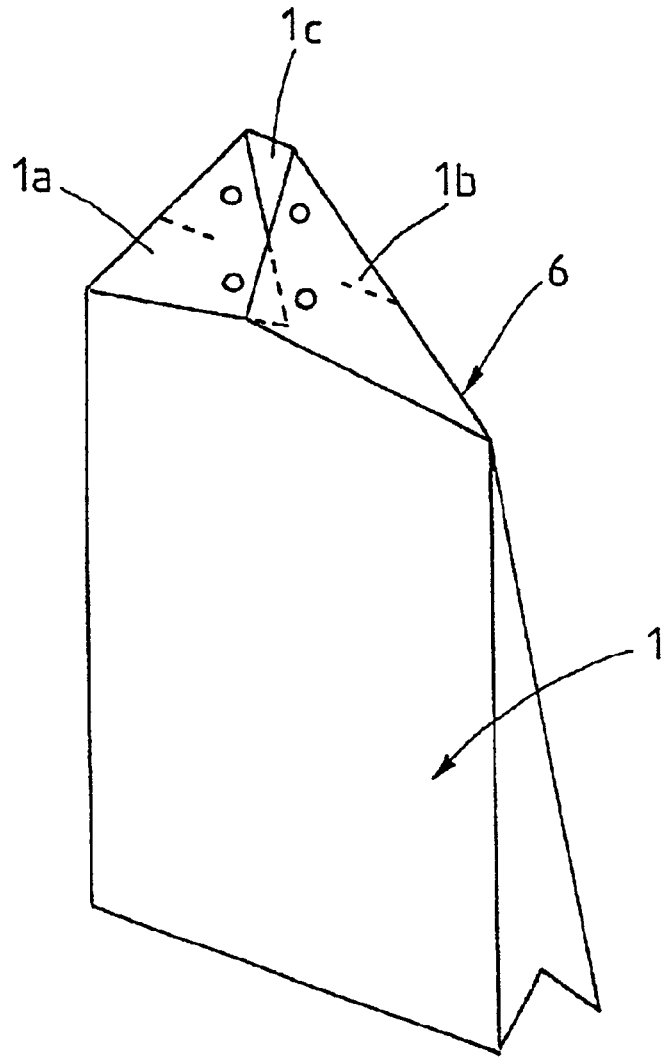
FIG. 1*c* shows the infusion bag in FIGS. 1*a* and 1*b* in the unfinished state without the string closure.

In FIG. 1*c*, the infusion bag shown in FIGS. 1*a* to 1*c* is first closed on its top part 6 by folding down the corners 1*a* and 1*b* and then folding the middle part 1*c* over them, so that the substrate found inside the chamber, especially tea, cannot get out. Then the infusion bag 1 in FIGS. 2*a* to 9*b* is provided with a string closure 7, whose construction can be inferred especially well from FIG. 1*b*. To make the string closure 7, on the top part 6, two holes 8 and 9 are made some distance apart laterally on the left and right of the longitudinal axis of the bag, each of which goes through one folded down corner 1*a* and 1*b* and the middle part 1*c* of the top part 6. To make this possible, according to FIG. 1*c*, in the top part 6 of the infusion bag 1, a total of four recesses are provided on the as yet not folded down middle part 1*c*, which after the middle part 1*c* is folded down correspond to one another in pairs and form the holes 8 and 9 passing through the same axis.

The string closure 7 also has a string 3, which forms a loop 3*a* with one end 3*b* through one hole 9 and the other end 3*c* of it through the second hole 8, whereby loop 3*a* is on the front of the bag 1 in the drawing, and ends 3*b* and 3*c* are on the back of the bag 1 in the drawing. The loop is placed over the top edge 10 of the infusion bag 1, and the two ends 3*b* and 3*c* of the string 3 are passed through the loop 3*a* from below. Pulling one or both ends of the string forms a double knot 11, which attaches corners 1*a* and 1*b* and the middle part 1*c* of the top 6 to one another and to the infusion bag in the closed position.

It can also be seen from the drawing that loop 3*a* is made of crossed parts of string laid one over another, whereby the short end of the string 3*b* is arranged under the long end 3*c* of the string next to the wall of the bag in the criss-crossed string parts of the loop.

Figure 2A:
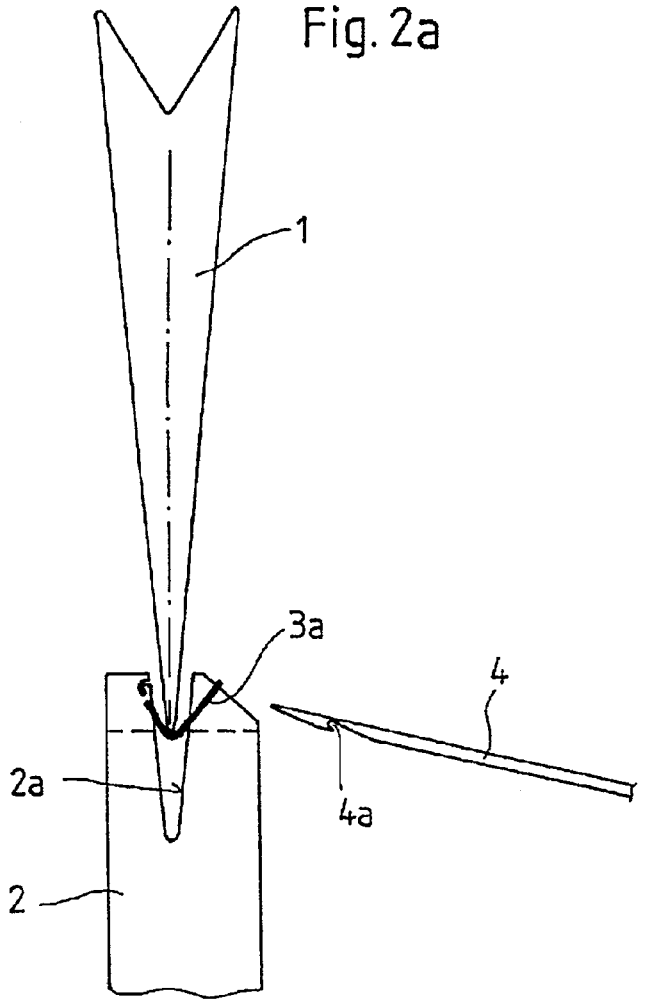
FIGS. 2*a*, 2*b* show a side view and a top view of an infusion bag inserted in a holder and a string made into a loop.
Figure 2B:
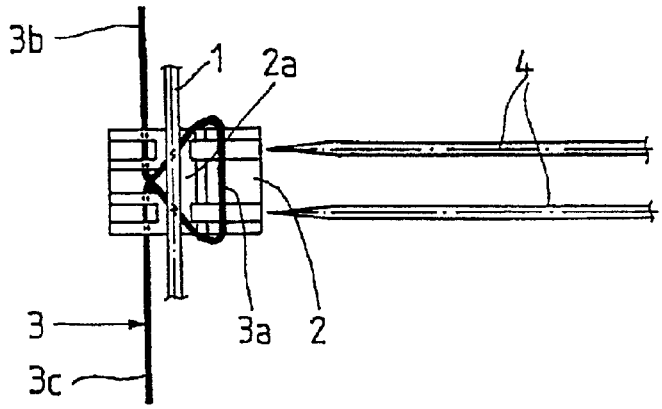

To produce the closure described, the infusion bag 1 in FIGS. 2*a* and 2*b* with its top part 6 closed is inserted in a recess 2*a* of a holder 2. Before that, a string 3 is laid over the recess 2*a* in the holder 2 in the form of a loop 3*a*, which can be best seen in FIG. 2*b*. The free end 3*b* of loop 3*a* here is put together with the continuous part 3*c* of the string 3 on the one side of the recess 2*a*, whereas the closed part of the loop 3*a* is on the other side of the recess 2*a* on the holder 2.

As can best be inferred from FIG. 2*a*, the loop 3*a* is pressed through the top edge of the infusion bag 1 into recess 2*a*, so that it lies over the top edge.

Figure 3A:
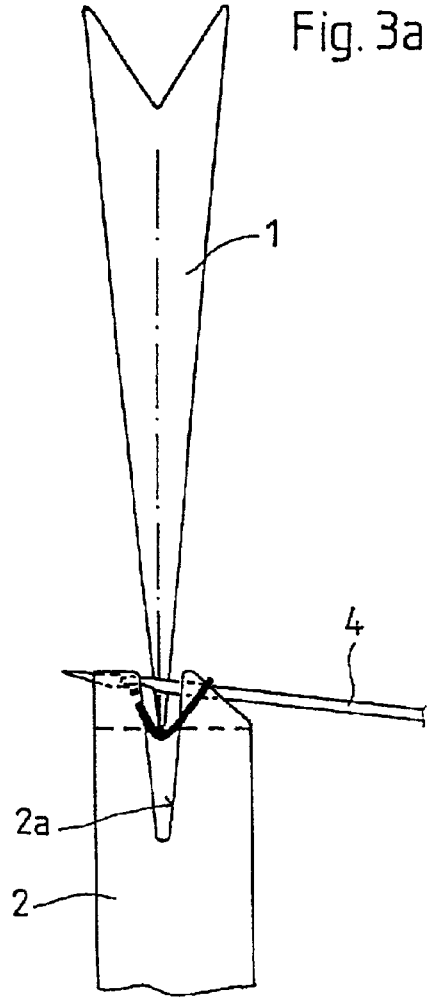
FIGS. 3*a*, 3*b* show a side view and a top view in which the needles have pierced the infusion bag.
Figure 3B:
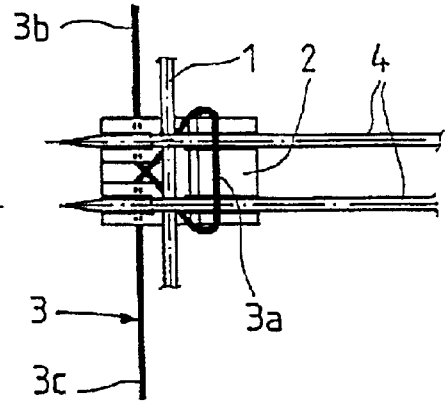

In FIGS. 3*a* and 3*b*, two needles 4, which are shown in the starting position in FIGS. 2*a* and 2*b*, go into the top part of the infusion bag under loop 3*a*. They grasp the free end 3*b* with their barb 4*a* (see FIG. 2*a*) on the bottom, on one hand, and part 3*c* of the continuous string 3, on the other, as shown in FIGS. 3*a* and 3*b*.

Figure 4A:
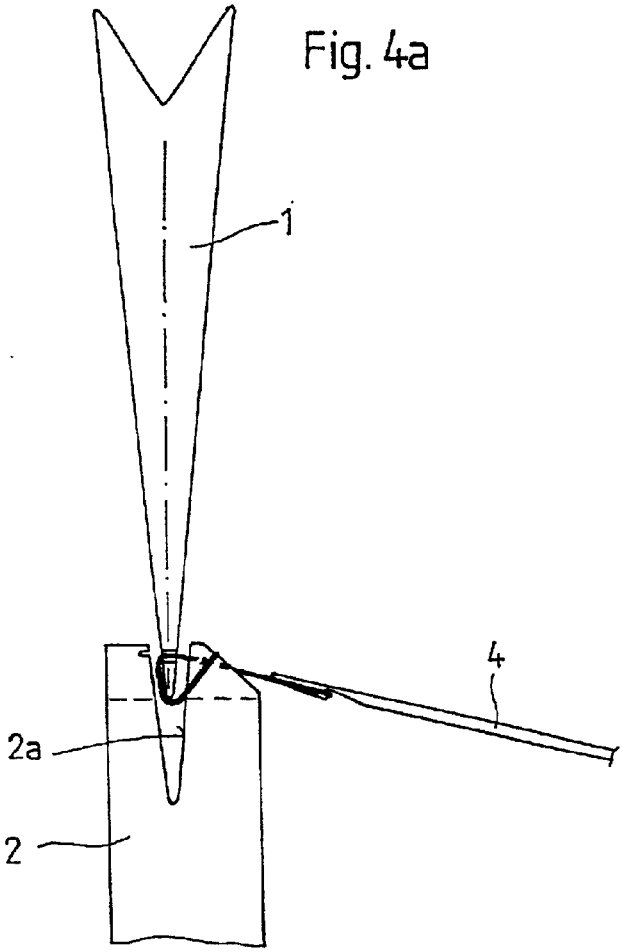
FIGS. 4*a*, 4*b* shows another side view and a top view in which the needles have been pulled back.
Figure 4B:
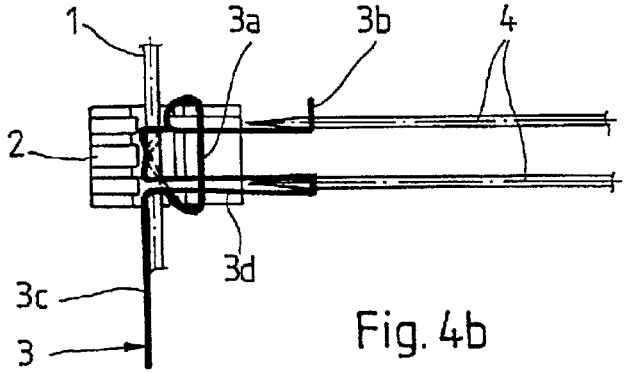

Now, when the needles 4 are pulled back into the starting position, as shown in FIGS. 4*a* and 4*b*, they take the free end 3*b*, on one hand, and part of the continuous part 3*c* of the string 3 with them, as FIGS. 4*a* and 4*b* show. While the free end 3*b* is pulled all the way out of the top part of the infusion bag 1, due to the withdrawal of the corresponding needle 4 a loop 3*d* is formed in the continuous part 3*c* of the string that is under the middle part of loop 3*a*. This situation is shown clearly in FIG. 4*b*.

Figure 5A:
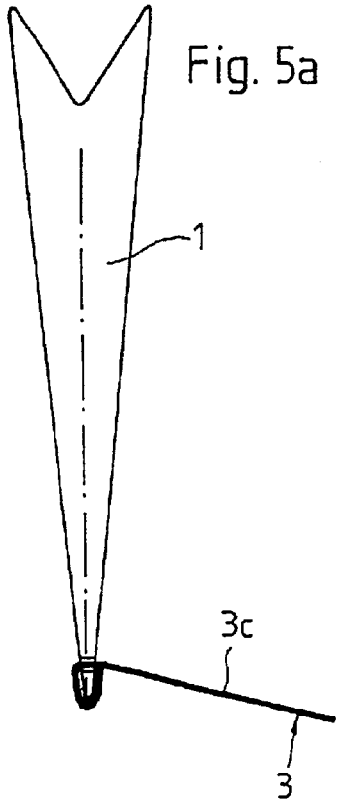
FIGS. 5*a*, 5*b* show a side view and a top view of the bag closed with the string.
Figure 5B:
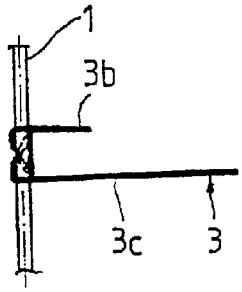

Now, to make a noose all around the top part of the infusion bag 1 with the ends of the string 3, as shown in FIGS. 5*a* and 5*b*, it is still necessary to pull the continuous part 3*c*, hence the long end of the string 3 completely out of the infusion bag 1. This is done, for example, by moving the infusion bag 1 on, so that the remaining part of the continuous part 3*c* of the string 3 is pulled completely through loop 3*a*. By applying a certain tensile strength on the continuous part 3*c* of the string 3, the noose is finally tightened so the situation shown in FIGS. 5*a* and 5*b* occurs.

Figure 6A:
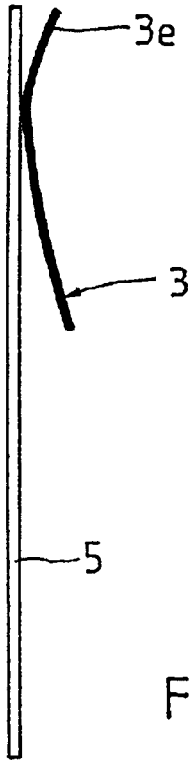
FIGS. 6*a*, 6*b* show a side view and a top view of a tag and the other end of the string.
Figure 7A:
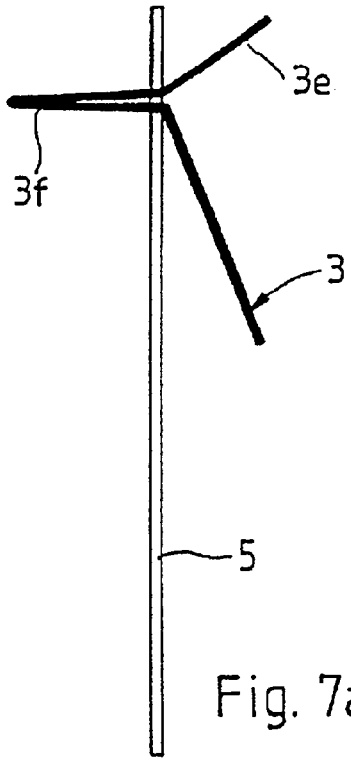
Figure 6B:
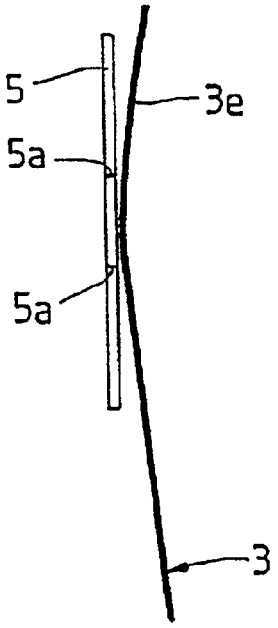
Figure 7B:
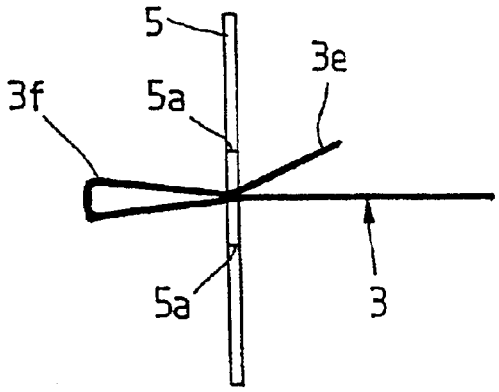

To attach a tag 5, shown in FIGS. 6*a* to 9*b*, to the other end of the string 3, it is placed with its end 3*e* on one side of the tag 5, as in FIGS. 6*a* and 6*b*. The tag 5 is pierced, preferably by means of a needle, in turn provided with a barb, and the end 3*e* of the string 3 is grasped. String end 3*e* is pulled through the tag 5 in the form of a loop 3*f* in FIGS. 7*a* and 7*b*.

Figure 8A:
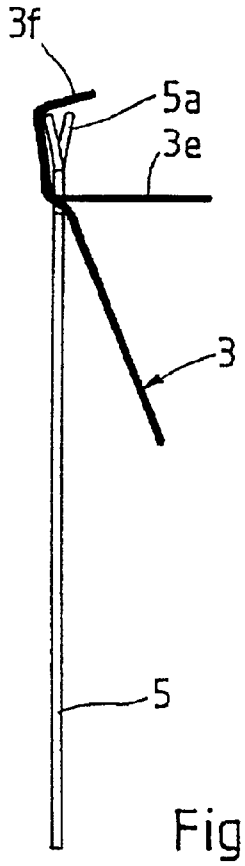
FIGS. 8*a*, 8*b* show another side view and top view in which the string loop has been placed in the notch in the tag
Figure 9A:
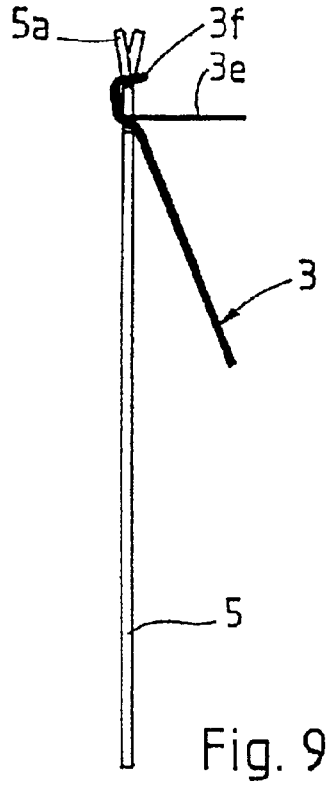
FIGS. 9*a*, 9*b* show a side view and a top view of the string attached to the tag.
Figure 8B:
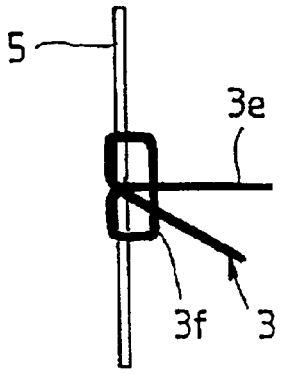
Figure 9B:
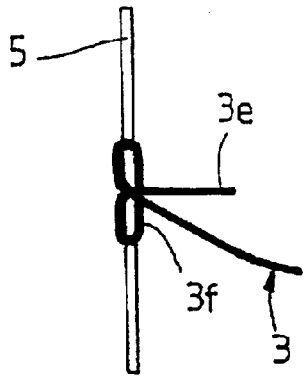

This loop 3*f* is now grasped and placed in slits 5*a*, according to FIGS. 8*a* and 8*b*, which are made on the edge of the tag. That way, the closed part of loop 3*f* comes back to the same side of the tag 5, on which the end 3*e* of the string and the continuous part of the string 3 are found. This situation can best be seen in FIG. 9*a*.

By pulling on the string 3, the tag 5 is looped around so that the situation shown in FIG. 9 occurs.

As can be seen from the preceding explanation of both the closure of the top part of the infusion bag 1 and the attachment of a tag 5 to the two ends of a string 3, the noose is made on the infusion bag 1 or tag 5 in both cases by simple means, to produce a reliable closure of the infusion bag 1 and a reliable attachment of the tag 5.

LIFT OF REFERENCES

1 infusion bag
1*a* corner
1*b* corner
1*c* middle part
2 holder
2*a* recess
3 string
3*a* loop
3*b* free end
3*c* continuous part
3*d* noose
3*e* end of string
3*f* loop
4 needle
4*a* barb
5 tag
5*a* slit
6 top part

7 string closure
8 hole
9 hole
10 top edge
11 knot

What is claimed is:

1. An infusion bag comprising:

a top part including folded down corners and a middle part folded over it;

in the top part, two holes are arranged at a lateral distance next to one another left and right, respectively, of a longitudinal axis of the bag, each of the holes penetrates one of the folded down corners and the middle part of the top part, respectively; and a string fastened to the bag and connected to a tag, wherein the string includes two free ends forming a loop, the loop is on one side of the top part and is placed over an edge of the top part, and the free ends are crossing over on a second side of the top part, and the free ends each run though one hole and pass from below through the loop forming a double knot such that the attachment of the folded down corners and the folded down middle part to one another and the bag is secured and the folded parts are kept together.

2. The infusion bag in claim 1, wherein the free ends include a short end and a long end, the short end is arranged in a crossed-over part of the loop below the long end next to a wall of the bag.

3. An infusion bag comprising:

a top part including folded down corners and a middle part folded over it;

in the top part, two holes are arranged at a lateral distance next to one another left and right, respectively, of a longitudinal axis of the bag, each of the holes penetrates one of the folded down corners and the middle part of the top part, respectively; and a string is fastened to the bag and connected to a tag, the string includes two free ends, wherein the string is fastened to the bag by the method of forming a loop of the string so that the loop is over an edge of the top part and the loop is on a first side of the top part and the free ends are on a second side of the top part, crossing the free ends over on the second side of the top part, and pulling each of the free ends through each of the holes so that the free ends are on the first side, and pulling the free ends from below through the loop forming a double knot such that the attachment of the folded down corners and the folded down middle part to one another and the bag is secured and the folded parts are kept together.

* * * * *